US010306362B1

(12) United States Patent
Russo et al.

(10) Patent No.: US 10,306,362 B1
(45) Date of Patent: May 28, 2019

(54) MICROPHONE REMOTE POSITIONING, AMPLIFICATION, AND DISTRIBUTION SYSTEMS AND METHODS

(71) Applicant: DYNAMOUNT, LLC, Ramona, CA (US)

(72) Inventors: Michael Russo, Ramona, CA (US); Jonathan Russo, La Jolla, CA (US)

(73) Assignee: Dynamount, LLC, Ramona, CA (US)

( * ) Notice: Subject to any disclaimer, the term of this patent is extended or adjusted under 35 U.S.C. 154(b) by 0 days.

(21) Appl. No.: 15/958,024

(22) Filed: Apr. 20, 2018

Related U.S. Application Data

(60) Provisional application No. 62/487,484, filed on Apr. 20, 2017.

(51) Int. Cl.
*H04R 3/00* (2006.01)
*H04R 5/027* (2006.01)
*H04R 1/08* (2006.01)

(52) U.S. Cl.
CPC ..... *H04R 3/005* (2013.01); *H04R 1/08* (2013.01); *H04R 5/027* (2013.01)

(58) Field of Classification Search
CPC ..... H04R 3/00
See application file for complete search history.

(56) References Cited

U.S. PATENT DOCUMENTS 2,969,436 A 1/1961 Kilyk
3,997,061 A 12/1976 Sano
5,265,490 A 11/1993 Azuma et al.
5,454,042 A 9/1995 Dreyer
6,105,454 A 8/2000 Bacchi et al.
6,788,337 B1 * 9/2004 Fujii ..... H04N 7/142 348/14.08
8,320,588 B2 11/2012 McPherson
9,414,144 B2 * 8/2016 Mathis ..... H04R 1/08
9,675,226 B2 6/2017 Kim et al.
2008/0187464 A1 8/2008 Guo et al.
2010/0201807 A1 8/2010 McPherson
2013/0093351 A1 4/2013 Chiu
(Continued)

FOREIGN PATENT DOCUMENTS

CN 203136096 U 8/2013
CN 103826173 A 5/2014
(Continued)

OTHER PUBLICATIONS

International Search Report dated Sep. 14, 2015 for PCT/US2015/037585.

*Primary Examiner* — Olisa Anwah
(74) *Attorney, Agent, or Firm* — Christopher M. Ramsey; GrayRobinson, P.A.

(57) ABSTRACT

A microphone positioning system includes a microphone coupler configured to hold a microphone and a microphone positioning mechanism having a low noise motor drive that moves the microphone coupler to different positions. A microphone cable connector is carried by the microphone positioning mechanism. A microphone preamp is also carried by the microphone positioning mechanism and is in signal communication with the microphone cable connector. A cable connector is carried by the microphone positioning mechanism and receives remote control signals that operate the low noise motor drive and move the microphone coupler.

21 Claims, 5 Drawing Sheets

(56) References Cited

U.S. PATENT DOCUMENTS

| | | | | |
|---|---|---|---|---|
| 2014/0233764 | A1* | 8/2014 | Mathis | H04R 1/08 381/122 |
| 2014/0306628 | A1* | 10/2014 | Benson | H02P 29/02 318/400.17 |
| 2017/0127162 | A9* | 5/2017 | May | H04R 1/02 |
| 2017/0142933 | A1* | 5/2017 | Neskin | H04N 5/77 |

FOREIGN PATENT DOCUMENTS

| | | | |
|---|---|---|---|
| JP | 58063820 | | 4/1983 |
| WO | 2007059550 | A1 | 5/2007 |
| WO | 2007095950 | A1 | 8/2007 |
| WO | 2014055436 | A1 | 4/2014 |

* cited by examiner

MICROPHONE REMOTE POSITIONING, AMPLIFICATION, AND DISTRIBUTION SYSTEMS AND METHODS

CROSS REFERENCE TO RELATED APPLICATION

This claims the benefit of priority to U.S. Patent Application No. 62/487,484, filed Apr. 20, 2017, which is incorporated by reference in its entirety.

FIELD

This relates to the technical field of remote positioning of devices and more specifically related to remote control of microphones for sound management.

BACKGROUND

In applications such as studio recording, live sound, filmmaking, and broadcast, the ability to remotely adjust a microphone's position and orientation in real time is desirable in order to best capture the appropriate sound at a given moment. Mechanisms that can accomplish this include pan/tilt systems, motorized axial sliders, linear actuators, and other similar devices that are physically capable of moving a microphone (also referred to as mic) in one or more axes. These mechanisms all require a power source and mechanism of receiving control commands. With some systems, both power and control signals can be managed over a single cable, for example via PoE (Power over Ethernet).

Unfortunately, conventional microphone positioning systems are useful only for positioning the microphone, not for capturing, amplifying, and distributing audio picked up by the microphone. Accordingly, conventional microphone positioning systems require additional electronic components to perform these extra functions.

BRIEF SUMMARY

The present inventors found that combining conventional robotic microphone positioning systems with the cables, amplifiers, and other components needed to manipulate the audio picked up by the microphone, introduced many problems, including audible noise and complicated wiring schemes.

An example of a microphone positioning system that addresses these problems includes a microphone coupler configured to hold a microphone and a microphone positioning mechanism having a low noise motor drive that moves the microphone coupler to different positions. A microphone cable connector is carried by the microphone positioning mechanism. A microphone preamp is also carried by the microphone positioning mechanism and is in signal communication with the microphone cable connector. A cable connector is carried by the microphone positioning mechanism and receives remote control signals that operate the low noise motor drive and move the microphone coupler.

The low noise motor drive may have a switching frequency of at least 20 kHz.

The microphone positioning mechanism may include a housing containing the low noise motor drive, microphone cable connector, microphone preamp, and cable connector. The housing may be waterproof.

A media networking module may also be carried by the microphone positioning mechanism and be in signal communication with the microphone preamp. The media networking module may be configured to generate AoIP data.

A cable may be connected to the cable connector, the cable being configured to transmit the remote control signals to the microphone positioning mechanism and to transmit audio signals from the microphone positioning mechanism.

The microphone positioning system may also include a microphone coupled to the microphone coupler, the microphone being oriented along a focal axis and a camera carried by the microphone positioning mechanism in such a way that the camera moves with the microphone coupler so that a focal position of the camera remains oriented substantially parallel to the focal axis when the microphone moves.

The microphone positioning may be in communication with a network including a plurality of the microphone positioning systems.

A distance between the microphone coupler and microphone cable connector is not more than two feet in certain examples.

A computer may be in communication with the cable connector to transmit the remote control signals. The computer may be remotely located relative to the positioning mechanism.

An example of an audio system includes a network and a plurality of individual microphones placed at different locations. The individual microphones are respectively coupled to a microphone positioning mechanism in communication with the network. A computer, in communication with the network, executes program instructions to operate, over the network, the plurality of microphone positioning mechanisms by remotely orienting a focal axis of at least one of the microphones in such a way that the focal axis points at a focal position of a video camera in communication with the network, the video camera being at a different location than the at least one microphone.

The audio system may further include a mixing console that receives an audio stream from the plurality of individual microphones to form a composite audio stream. The mixing console may increase a relative volume of the audio stream from the microphones having their focal axis pointed at the focal position of the selected video camera relative to microphones not having their focal axis pointed at the focal position of the selected video camera.

The audio system may further include a mixing console that receives an audio stream from the plurality of individual microphones to form a composite audio stream. The mixing console may increase a relative volume of the audio stream from the microphones having their focal axis pointed at the focal position of the selected video camera relative to microphones not having their focal axis pointed at the focal position of the selected video camera. From the microphones having their focal axis pointed at the focal position of the video camera, a relative volume in the composite audio stream from the microphones that are closer to the focal position is increased by the mixing console.

The computer may further execute program instructions to automatically reorient the individual microphones in such a way that their focal axis remains pointed at the focal position of the selected video camera as the focal position of the selected video camera moves.

The audio system may be used in conjunction with the aforementioned microphone positioning system.

An example of a method of remotely capturing audio of an event at a venue includes receiving, at a computer system over a network, positional data from at least one video camera connected to the network and placed at a location about the venue, the positional data corresponding to a focal position of the video camera. The method also includes operating, over the network, a plurality of remotely controlled microphones placed at different locations about the venue from the video camera by remotely orienting a focal axis of at least one of the microphones in such a way that the focal axis points at the focal position of the video camera.

The method may also include receiving an audio stream from the plurality of microphones to form a composite audio stream. A relative volume of the audio stream from the microphones having their focal axis pointed at the focal position of the selected video camera relative to microphones not having their focal axis pointed at the focal position of the selected video camera is increased.

The method may also include receiving an audio stream from the plurality of microphones to form a composite audio stream. A relative volume of the audio stream from the microphones having their focal axis pointed at the focal position of the selected video camera relative to microphones not having their focal axis pointed at the focal position of the selected video camera is increased. From the microphones having their fical axis pointed at the focal position of the video camera, a relative volume in the composite audio stream from the microphones that are closer to the focal position is increased.

The method may also include automatically reorienting the microphones in such a way that their the focal axis remains pointed at the focal position of the selected video camera as the focal position of the video camera moves.

The method may be practiced in conjunction with the aforementioned microphone positioning system and/or audio system.

DETAILED DESCRIPTION OF EXAMPLE EMBODIMENTS

Figure 1:
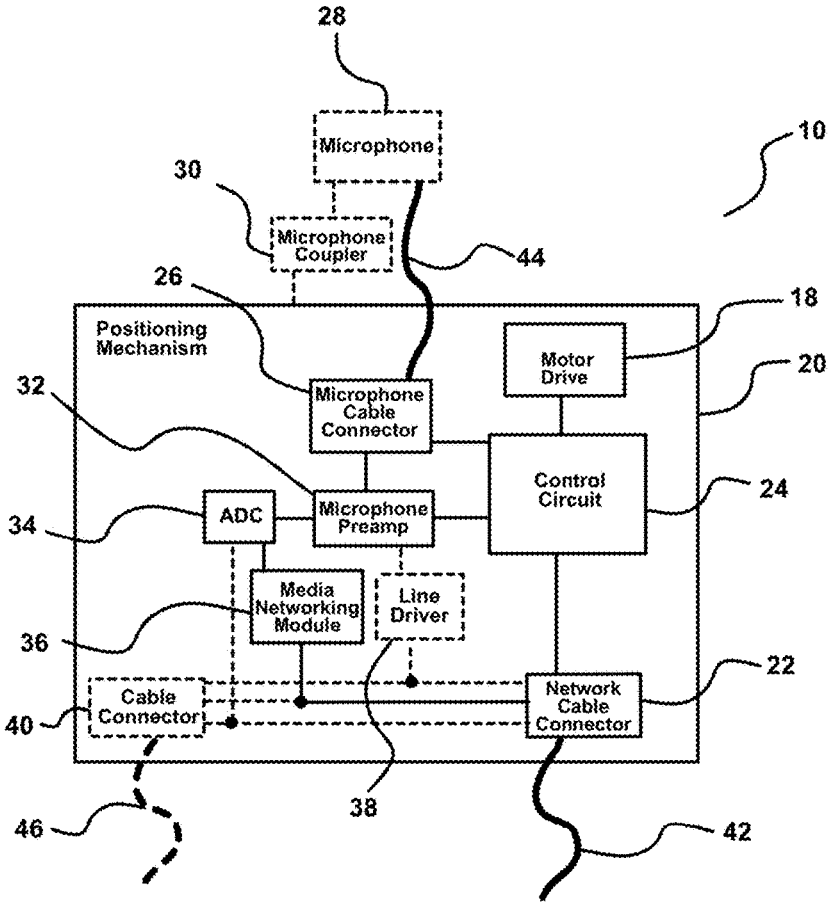
FIG. 1 is a block diagram of an example of the microphone positioning and amplification system.

Conventional robotic microphone positioning systems offer no inputs for electrical or signal coupling with the payload. Many of these systems generate audible noise either from the motors or control circuitry which is not acceptable in microphone positioning applications. As these systems offer no microphone inputs, it is required for sound captured by an affixed microphone to be sent over dedicated audio cable (XLR for example) in the form of a low voltage analog signal to a preamp or other receiving device which may be located in a control room, sound booth, field box, or other similar area located some distance from the positioning mechanism.

This construction is not ideal. The cable length from the microphone to receiving device should be kept to a minimum to ensure analog signal integrity. A wireless microphone could be used to solve this problem, but wireless microphones are often not desirable in noisy broadcast situations, reduce signal quality compared to a hard-wired connection, have limited battery life, and severely limit the variety of microphones that may be employed.

Remote microphone positioning systems that have been designed primarily for compatibility with video cameras also exist, but also include drawbacks for capturing audio. While not of much concern when capturing video, many of these systems generate audible noise which is not acceptable in microphone positioning applications. These systems may offer one or more connections such that a variety of cameras may be compatible for electrical and/or signal coupling with the system. However, these positioning systems do not offer a separate input for a microphone.

Even if capturing only audio is desired, a camera must still be affixed and used along with a compatible microphone. This setup requires the audio to first run through an on-board analog-to-digital converter (ADC) inside the camera and be mixed in with the digital data stream before being output from the camera to the positioning system. This also requires that the affixed camera is large enough to support an external microphone, which may be quite large in the case of commonly used shotgun-style directional microphones.

This is very inefficient as it requires a larger than necessary positioning system and adds costly and unnecessary equipment when only capturing audio is desired. It is also quite common for the desired microphone position/orientation at a given moment to not simply be inline/parallel with that of a nearby camera employed to visually capture the same event or scene. For example, in the case of high-powered zoom cameras it is not practical to have a microphone mounted in the same physical location with a matching position/orientation since even highly directional microphones may be unable to capture audio from target sources located a significant distance away.

The inventors found it desirable to have a remote microphone positioning system that can receive analog audio signal from a microphone on a short cable, digitize it, and manipulate the microphone position/orientation independently of any nearby camera(s) to solve these problems.

There is frequently a local area network setup and used (with or without a connection to the broader internet) during event broadcasts, filmmaking, and other live productions to enable various devices to communicate and exchange data for a variety of reasons using a common protocol such as TCP/IP. It would thus be desirable to have a microphone positioning system that is compatible with this existing infrastructure and capable of sending/receiving control data to/from other devices remotely over the network, providing efficiency and cost savings benefits over requiring a dedicated hardware controller or a manual operator located in close proximity to the system.

It is also becoming more common for high-quality low-latency digital audio itself to be transmitted between various nodes on a network, known as "Audio over IP" (AoIP). To convert from the low voltage analog signal output by a standard microphone to a digital format or protocol acceptable for AoIP requires a piece of equipment external to the microphone. Common examples of this equipment include rackmount converters and inline devices capable of amplifying and converting the audio signal.

The use of AoIP equipment with a microphone offers several advantages over traditional setups including replacing point-to-point transmission of audio data with the ability to multicast the digital audio data out to a multitude of other devices simultaneously as nodes in the network. Additionally, small inline AoIP equipment installed near the microphone has the added benefit of removing the need for any other dedicated audio equipment nearby (e.g. field box with rackmount preamps and ADCs) and in its place only common networking equipment is needed (e.g. Ethernet switch). Therefore, significant gains in real-time control and flexibility could be realized along with a reduction in overall setup costs via a network-connected microphone positioning system with integrated AoIP functionality.

If a multitude of microphones are having their positions/orientations manipulated simultaneously, it is difficult to manually control their respective volumes in real-time and achieve a preferred overall sound balance. There exist methods of tracking a particular target object, such as a sports player or the ball in a broadcast example, where the tracking is accomplished through analyzing data provided by an array of dedicated tracking cameras, by using RFID tags, or even by following the actual sound generated by the target. One downside of these solutions is that most require dedicated tracking hardware which increases the complexity and costs associated with setup. Some of these solutions also include a mechanism of automatically adjusting volume levels of employed microphones in an attempt to maintain a consistent overall sound level for the target object.

In many situations, as opposed to a consistent overall sound level for a particular target object, what may be desired is to have the overall captured audio accurately correspond with video captured by a particular video camera. For example, in the case of high-powered zoom cameras a desirable scenario would be to have the camera mounted at some distant vantage point while having an array of microphones located much closer to the target area able to capture audio corresponding with the camera's target view at any given moment, thus providing the viewer with a dynamic but natural audio visual experience. Therefore, a method of automating remote microphone positioning based on a particular camera's real-time positional data coupled with automated volume control of employed mics is desired.

Accordingly, described herein is a remote positioning system specifically designed for use with a microphone. This system generates no or virtually no audible noise, even while in motion. This system is small, light, and capable of mounting using standard microphone threads, so that an audio professional may use common mic stands, boom poles, or other similar supports already in their inventory.

There is a further need for this system, in addition to manipulating the position/orientation of the microphone, to have an integrated preamp, ADC, and AoIP functionality to respectively amplify, convert, and distribute the captured audio signal from a location as close to the microphone as possible.

In addition, there is a need for a system and method of automating the manipulation of real-time position/orientation and volume control for affixed microphones in an array of these systems corresponding to positional data from a particular camera.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments and/or implementations described herein. However, it will be understood by those of ordinary skill in the art that the embodiments and/or implementations described herein may be practiced without these specific details. In other instances, well-known methods, procedures and components have not been described in detail so as not to obscure the embodiments and/or implementations described herein. Furthermore, this description is not to be considered as limiting the scope of the example embodiments described herein, but rather to describe the structure and operation of the various embodiments and/or implementations described herein.

Referring to FIG. 1, an example of the microphone positioning and amplification system 10 includes a microphone 28 that is mechanically coupled to a dynamic portion of a positioning mechanism 20 via a microphone coupler 30 which may be a threaded adapter, clamp, quick release, or other coupling device.

This positioning mechanism 20 may take many forms depending on the desired application, though in any case is capable of physically manipulating a microphone's position and/or orientation in one or more axes. For example, the positioning mechanism 20 could be a panning device, a tilting device, a pan/tilt, a slider or rail with single or multiple lateral axes, a linear actuator, or any combination thereof.

The positioning mechanism 20 may include a housing that encloses the components. The housing may be constructed with waterproof materials if desired to protect the components from inclement weather.

The microphone 28 outputs a low voltage analog audio signal along a short microphone cable 44 (XLR or TRS, for example). The other end of the microphone cable 44 mates with a microphone cable connector 26 integrated into the positioning mechanism 20. This allows for audio signal captured by the microphone 28 to be transmitted through the microphone cable connector 26 and into a microphone preamp 32 located inside the positioning mechanism 20 with minimal cabling distance required.

The integrated microphone preamplifier (preamp) 32 is an electronic circuit having the primary function of increasing gain on the low voltage analog audio signal received from the microphone. Amplifying the lower "mic level" signal (−60 to −40 dBu) to a higher "line-level" signal (+4 dBu) significantly increases the peak-to-peak voltage of the analog signal, making it more suitable for traveling longer cable distances or for being digitized by an ADC. The preamp circuit may include preamplifier ICs, op-amps, resistors, capacitors, vacuum tubes, relays, power regulators, and other similar or corresponding circuitry. It is important for the sake of audio signal integrity to minimize electrical noise of any kind within the preamp circuit. Care should be taken in the design of the preamp circuit to electrically isolate it as much as possible from other noisier circuitry which may be nearby, such as the motor drive 18. In one example, a conductive EMI shield may be installed over the entire preamp circuit and connected to a reference ground voltage in order to minimize susceptibility to external interference.

If needed, power may be provided to the microphone 28 via a phantom power circuit located within the positioning mechanism 20 and sent out through the microphone cable connector 26. In one example, the amplified audio signal may be routed to an analog to digital converter 34 for digitization and then delivered to an integrated media networking module 36.

The microphone cable connector 26 may take one of many different possible forms depending on the intended application. Typically, the low voltage analog audio signal from a standard microphone will be transmitted across a differential pair of conductors, with an additional single conductor being dedicated to sharing a common reference or "ground". As such, the total number of conductors equals 2*N+1, where N is the number of individual capsules or channels on the microphone. Some typical examples of the microphone cable connector may include a 3-pin male XLR connector for a single-channel (mono) microphone, a female TRS (Tip-Ring-Sleeve) jack for a mono mic, a 5-pin male XLR connector for a two-channel (stereo) microphone, or even a connector with a larger number of conductors for mounting multi-capsule microphone array units. In one example, it may be preferred to use a waterproof panel-mount microphone cable connector to allow for use in inclement weather.

A media networking module 36 may perform various actions on the audio data including but not limited to format conversions, timing synchronization, and latency monitoring, as well as performing networking functions such as device discovery, all in order to achieve the desired AoIP functionality.

The AoIP audio data may then be routed from the media networking module 36 and output from the positioning mechanism 20 either through the network cable connector 22 and primary multi-conductor cable 42, or through a secondary cable connector 40 and secondary multi-conductor cable 46 to be delivered elsewhere in the network.

Other examples may exclude the analog to digital converter 34 and media networking module 36, instead passing the amplified analog audio signal from microphone preamp 32 to a line driver 38 for additional amplification and then directly out through either the network cable connector 22 and primary multi-conductor cable 42, or through a secondary cable connector 40 and secondary multi-conductor cable 46 to be delivered elsewhere.

The media networking module 36 is an electronic circuit designed primarily to manage the streaming of AoIP data out to a network. In one example, this circuit may accept digitized audio data in a serial bus interface standard such as $I^2S$ (Inter-IC Sound). The audio data is then converted and formatted as necessary to be compatible with the AoIP protocol of choice (e.g. Dante, RAVENNA, AES67, etc.).

In addition to converting the audio data, the media networking module 36 may perform tasks such as timing synchronization, latency monitoring, and device discovery. A media networking module 36 within one system can easily interface and exchange AoIP data with a media networking module 36 located within another system(s) connected to the same network, so long as they operate using compatible AoIP protocols.

The media networking module 36 may include specialized integrated circuits, networking interfaces, memory chips, FPGAs, serial interfaces, ADCs, and other similar or corresponding circuitry. In one example, the media networking module 36 may have a link to the network via a dedicated network cable connector 22 and network cable 42. In another example, a network switch circuit may be integrated into the media networking module 36 such that a single network cable and connector may be shared with a primary control circuit within the microphone positioning and amplification system 10.

Control commands and power for the system are delivered via the primary multi-conductor cable 42 which is connected to the network cable connector 22. Control commands originate from another node in the network and traverse through cable 42 into control circuit 24, which then interprets these commands.

The network cable connector may, for example, take the form of an 8P8C (8 Position, 8 Contact) modular connector such as RJ45, as this has become the universal standard for Ethernet communication. The mating network cable may in this case include four sets of differential twisted-pair conductors in order to minimize electromagnetic radiation, interference susceptibility, and crosstalk. This arrangement also allows for the use of accepted standards such as IEEE802.3at (PoE+) to achieve both DC power and data transmission along a single cable and through the network cable connector. In most applications, a category type 6 (Cat 6) or higher network cable and network cable connector may be preferred, as these allow for higher data rates of 1000+ Mbps. In one example, it may be preferred to use a waterproof panel-mount network cable connector to allow for use in inclement weather.

The control circuit 24 may include a microcontroller or microprocessor, transceivers, power regulators, serial interfaces, peripheral inputs, and other similar or corresponding circuitry. If a command calls for manipulation to the position/orientation of an affixed microphone 28, appropriate signals are forwarded from the control circuit 24 to the motor drive 18 in order to trigger the actual motion.

The motor drive 18 may include electric motors, motor drivers, encoders, potentiometers, gears, and other similar or corresponding components. The motor drive 18 should preferably generate no or virtually no audible noise detectable by the microphone 28. The term low noise motor drive refers to a motor drive that does not substantially generate audible noise detectable by the microphone being used.

In a particular example embodiment, the motor drive 18 includes brushless (BLDC, or stepper motors for example) with internal ball bearings in order to minimize mechanical noise. The motor drive 18 may have a switching frequency of at least 20 kHz.

Motor drivers for brushless motors typically have an operating switching frequency which may fall into the audible range (<20 kHz). Therefore, it is important to carefully design or select motor driver circuitry which operates with a switching frequency at least 20 kHz and above to avoid any audible noise being picked up by an affixed microphone 28.

If a geared motor drive system is employed, any metal-on-metal gear contacts should be avoided to minimize mechanical noise. Instead, gears made out of a high-strength low-friction plastic such as polyacetal may be used, or a combination of metal and plastic gears so long as any metal-on-metal contacts are avoided or minimized.

Control commands may also include requested adjustments to various settings such as gain and equalization on the preamp 32 and/or analog to digital converter 34 and/or media networking module 36. In these cases, control signals are forwarded from the control circuit 24 to the appropriate component(s) to trigger the desired action.

Alternatively, the media networking module 36 itself may directly receive commands over the network through either the primary multi-conductor cable 42 and network cable connector 22, or through the secondary multi-conductor cable 46 and secondary cable connector 40. In these cases, it may not be required to involve a separate control circuit 24 as the media networking module 36 could manage some of the same tasks, such as adjustments to gain on the preamp 32 or potentially even communication with the motor drive 18, although perhaps with more limited processing power and flexibility to integrate other peripherals.

Figure 2:
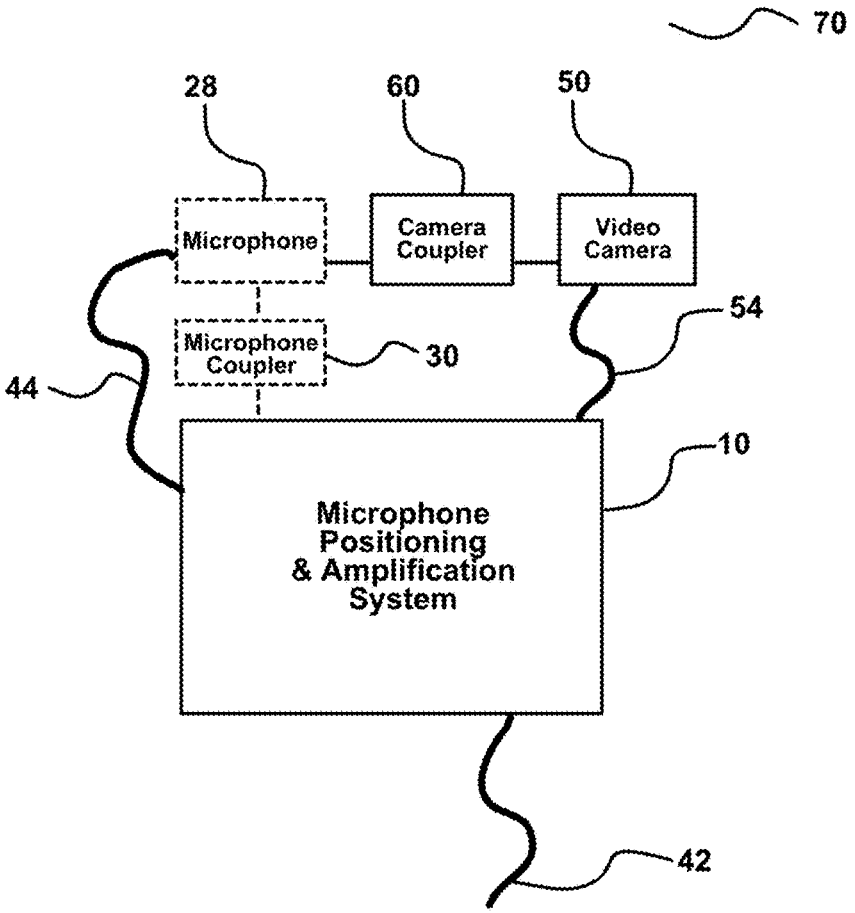
FIG. 2 is a block diagram of an example of the microphone positioning and amplification system where a video camera is mechanically coupled to the microphone for remote monitoring.
Figure 3:
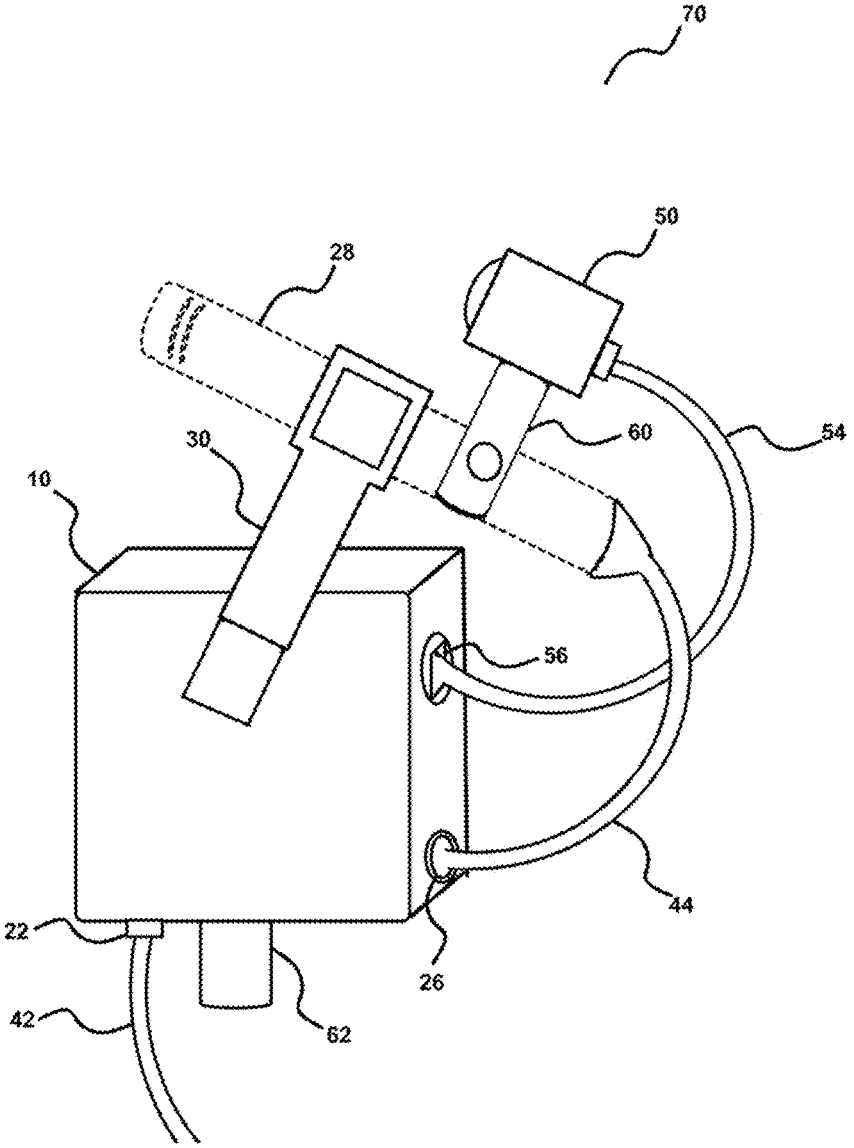
FIG. 3 is a perspective view of the microphone positioning and amplification system of FIG. 2.

Referring now to FIG. 2 and FIG. 3, there is shown an example embodiment of a system 70, which includes a microphone positioning and amplification system 10 as described in FIG. 1 with the addition of a video camera 50.

The video camera 50 is fastened to the microphone 28 via a camera coupler 60 which may take the form of a clamp, threaded adapter, strap, or other mechanical coupling mechanism. It may be desired to mount the video camera 50 in such a way that it is facing in generally the same direction as the microphone 28 in order to serve as a visual reference of the microphone's orientation and target area at a given moment.

The microphone 28 is mechanically coupled to the microphone positioning and amplification system 10 via a microphone coupler 30. The microphone 28 is electrically coupled to the microphone positioning and amplification system 10 via a microphone cable 44. The video camera 50 is electrically coupled to the microphone positioning and amplification system 10 via a multi-conductor cable 54.

In a particular example embodiment, video and/or audio data is analyzed, either within the microphone positioning and amplification system 10 itself or within an external controlling device, in order to automatically manipulate the position of the microphone 28. In another embodiment, video and/or audio data is analyzed by an operator to manually issue control commands to manipulate the position of the microphone in order to best capture the desired audio.

In further detail, still referring to FIGS. 2 and 3, the video camera 50 is mechanically coupled to the microphone 28 via a camera coupler 60. The video camera 50 is mounted in such a way that it is parallel or nearly parallel to the microphone 28 and its direction of focus matches or approximately matches the direction of the microphone 28. The video camera 50 outputs its video data through a multi-conductor cable 54 which in turn mates with the microphone positioning and amplification system 10 via a video cable connector 56.

The entire microphone positioning and amplification system 10 may be mounted to any conventional microphone stand, boom arm, mount, or other suitable support structure via a mounting adapter 62. The mounting adapter 62 may take the form of a threaded adapter, quick release mechanism, clamp, or other sufficiently sturdy fastening means.

Figure 4:
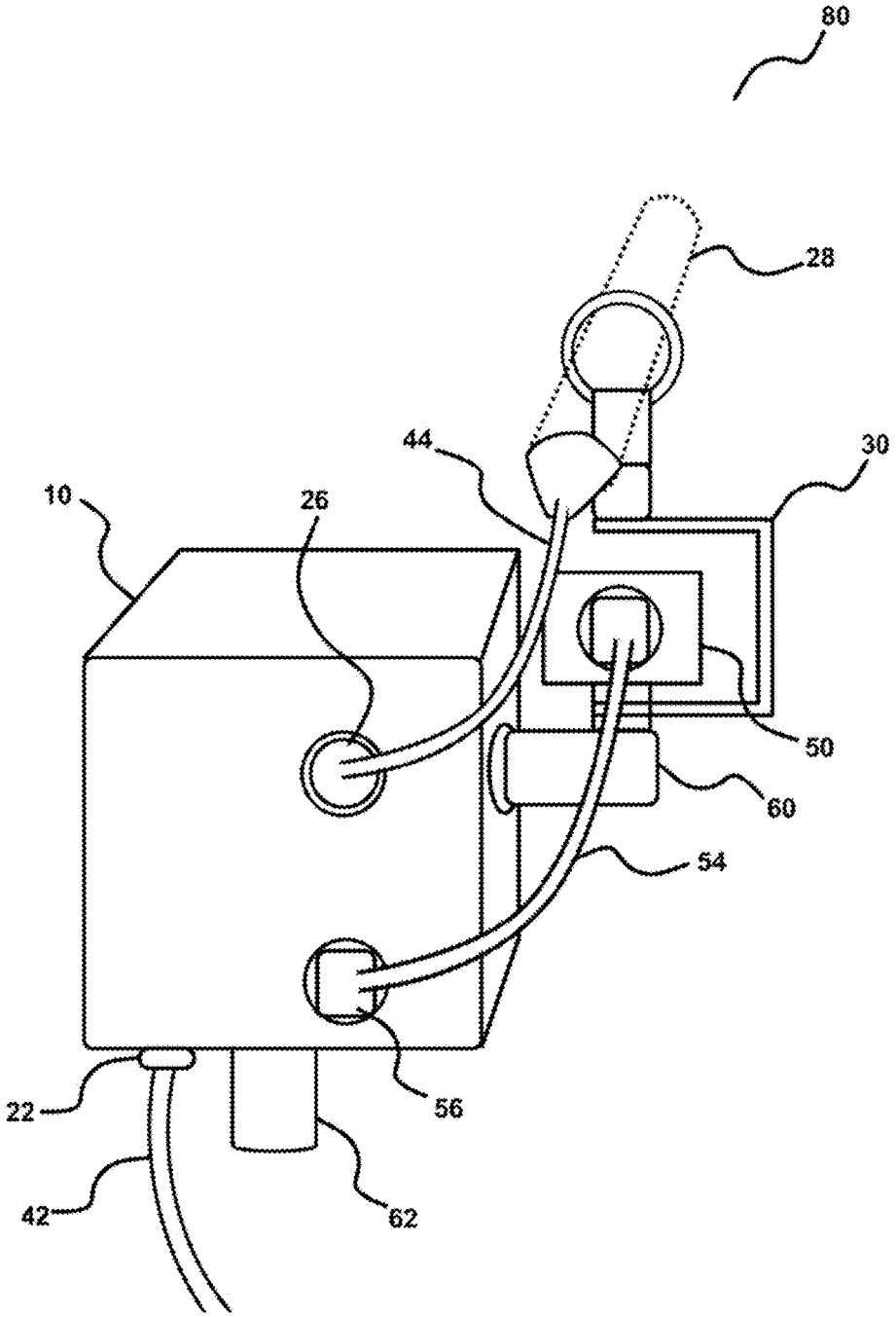
FIG. 4 is a perspective view illustrating another example of the microphone positioning and amplification system where the video camera is mechanically coupled directly to the positioning system.

Referring now to FIG. 4, there is shown another example embodiment of a system 80, which includes a microphone positioning and amplification system 10 as described in FIG. 1 with the addition of a video camera 50.

The video camera 50 is fastened to the microphone positioning and amplification system 10 via a camera coupler 60. The microphone 28 is fastened to the microphone positioning and amplification system 10 via a microphone coupler 30.

Alternatively, the microphone 28 may instead be fastened to the camera coupler 60 via a microphone coupler 30, forming in essence a single mechanical coupler for both the microphone and video camera to be affixed to a dynamic portion of the microphone positioning and amplification system 10.

In either case, the video camera 50 is mounted in such a way that it is parallel or nearly parallel to the microphone 28 and its direction of focus matches or approximately matches the direction of the microphone 28.

The video camera 50 outputs its video data through a multi-conductor cable 54 which in turn mates with the microphone positioning and amplification system 10 via a video cable connector 56.

The microphone 28 outputs the captured analog audio signal along a short microphone cable 44 (XLR or TRS, for example). The other end of the microphone cable 44 mates with a microphone cable connector 26 integrated into the microphone positioning and amplification system 10.

The entire microphone positioning and amplification system 10 may be mounted to any conventional microphone stand, boom arm, mount, or other suitable support structure via a mounting adapter 62. The mounting adapter 62 may take the form of a threaded adapter, quick release mechanism, clamp, or other sufficiently sturdy fastening means.

The analog audio signal or AoIP audio data may then be sent out either through the primary cable connector 22 and primary multi-conductor cable 42, or through a secondary cable connector and secondary multi-conductor cable to be delivered elsewhere. The video data may either be analyzed within the microphone positioning and amplification system 10 or sent out to an external controlling device through either the primary cable connector 22 and primary multi-conductor cable 42, or through a secondary cable connector and secondary multi-conductor cable.

Figure 5:
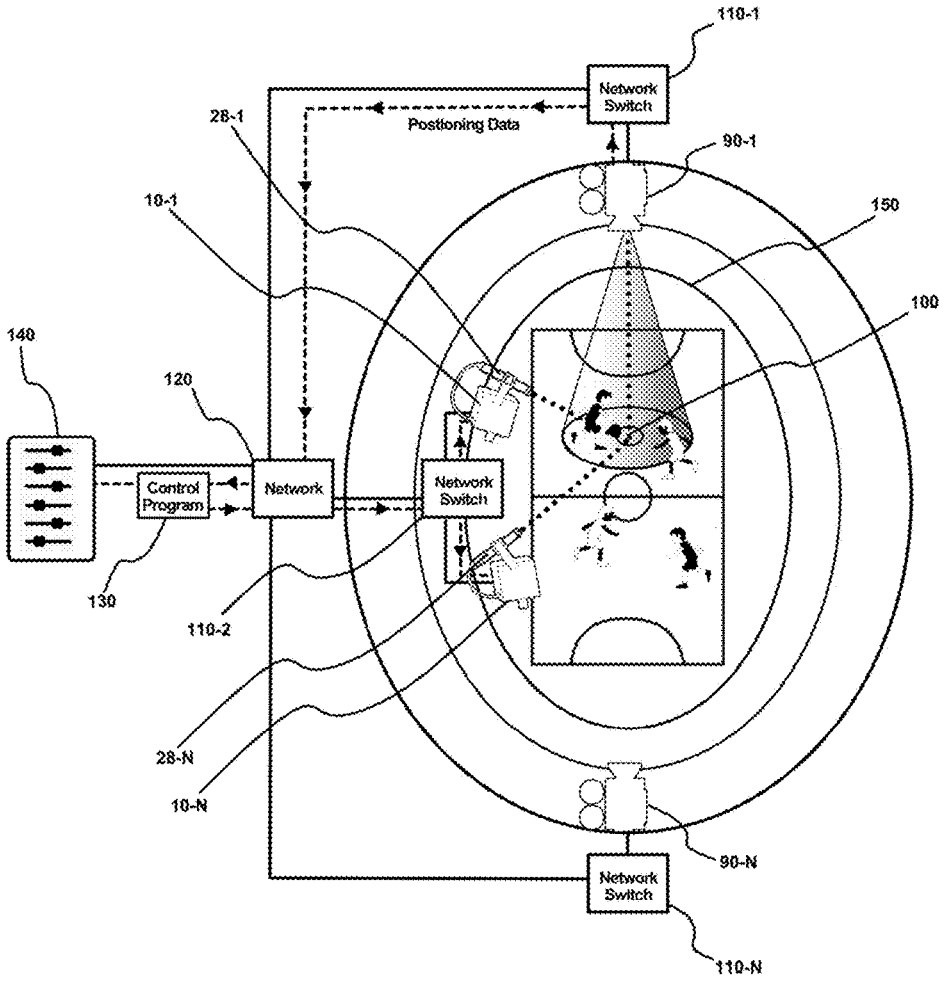
FIG. 5 is a schematic illustrating an example of a system and method for manipulating the position/orientation of a plurality of microphones, along with adjusting their corresponding volumes, based on positional data from a particular camera.

Referring now to FIG. 5, there is shown a plurality of microphone positioning and amplification systems (10-1 to 10-N) automatically manipulating the position/orientation of each affixed microphone (28-1 to 28-N) based on the real-time positioning data provided by a separate video camera 90-1. Here, the indicator "-N" refers to the number of each component specified in the system.

Such a configuration is advantageous for capturing audio and/or video from an event at a venue, such as a sporting event, a concert, or other type of event.

Each of the microphones has a focal axis indicated by the dashed line extending therefrom. The focal axis represents the direction in which the microphone is designed to pick up the strongest audio.

The video camera 90-1 is fitted with a zoom lens and located at a chosen vantage point with an overall possible field of view 150. As the position/orientation of the video camera 90-1 is manipulated, either manually or via remote control, its real-time positional data is output through a network switch 110-1 to a network 120.

Each video camera 90-N has a focal position, which is illustrated by the cone emanating therefrom. The focal position is the central point of the cone or the point on which the video camera 90-N is focused.

In one example, the positional data is received by a control program 130 which may analyze and interpret the data before forwarding it to the plurality of microphone positioning and amplification systems (10-1 to 10-N). In another example, the positional data flows from the video camera 90-1 through the network 120 to the plurality of microphone positioning and amplification systems (10-1 to 10-N) without the control program 130 first interpreting the data. In either example, the positional data is received through one or more network switches (110-2 to 110-N) by the plurality of microphone positioning and amplification systems (10-1 to 10-N) which in turn each manipulate the position/orientation of an affixed microphone (28-1 to 28-N) to target the same area being focused on by the video camera 90-1.

So long as the elevation of the overall possible field of view 150 is known along with the three-dimensional location coordinates for the camera 90-1 and each of the microphone positioning and amplification systems (10-1 to 10-N), then it is only a matter of trigonometry for each microphone positioning and amplification system (10-1 to 10-N) to calculate the required orientation for its affixed microphone (28-1 to 28-N) using the real-time positional data from the camera 90-1. The low noise motor drive in each microphone positioning and amplification system (10-1 to 10-N) is then activated to trigger the actual motions.

In a particular example, each of the microphone positioning and amplification systems (10-1 to 10-N) is fitted with an internal navigation module (e.g. GPS receiver) so that it may easily and automatically determine its location in three dimensions. This would reduce setup time and allow for on-the-fly relocation of one or more of the microphone positioning and amplification systems (10-1 to 10-N) to another location in the vicinity of the overall possible field of view 150 without requiring manual updates to any system configurations.

In another example, the camera 90-1 has a rangefinder attached or built into it such that along with camera positional data it may output range-finding data describing its distance to the center of its target field of view 100 in real-time. This would improve efficiency as no coordinate mapping of the overall possible field of view 150 is then required during setup. In this case, so long as the three-dimensional coordinates for the camera 90-1 and each of the microphone positioning and amplification systems (10-1 to 10-N) are known, and the camera 90-1 outputs both positional and range-finding data, then it is only a matter of trigonometry for each microphone positioning and amplification system (10-1 to 10-N) to calculate the required orientation for its affixed microphone (28-1 to 28-N) using the real-time positional data from the camera 90-1.

In another example, as an alternative to a dedicated range-finding sensor on or within the camera, the camera's focal distance is used to estimate the range to the center of its target field of view 100 in real-time.

In further detail, still referring to FIG. 5, over the course of an event or live production the camera 90-1 may be frequently pointed at various places around the overall possible field of view 150. As the camera 90-1 is moved, the proximity of each microphone positioning and amplification system (10-1 to 10-N) to the center of the camera's target field of view 100 will vary in real-time.

A control program 130 is run on a device (e.g. mixing console, computer, one of the microphone positioning and amplification systems, etc.) connected to the network 120. The control program 130, which may or may not include a user interface or UI, is employed to handle various command and control requirements including management of real-time positional data relating to the distance between the center of the camera's target field of view 100 and each of the microphone positioning and amplification systems (10-1 to 10-N).

If a computer is used, the computer includes a processor capable of executing program instructions stored on non-transitory computer memory medium such as a hard drive or external memory. The control program 130 may be stored on the memory.

The control program 130 is also configured such that it can communicate with and modify parameters on a mixing console 140, which may be either physical or virtual, through either a direct wired/wireless connection or via the network 120.

The mixing console 140 is tasked with controlling, among other things, the relative volumes of the AoIP audio streams output by each of the microphone positioning and amplification systems (10-1 to 10-N). To obtain the most accurate representation of the sound generated from within the camera's target field of view or focal position 100, with minimal sound captured from outside the camera's target field of view 100, priority is given to the microphone positioning and amplification system(s) that are in the closest proximity to the camera's focal position 100 at a given moment. The mixing console 140 may be a computer or other type of audio mixing device.

The exact parameters may be adjusted by a user as desired, but as the camera's focal position 100 moves closer to a particular microphone positioning and amplification system, the control program 130 automatically increases the relative volume at the mixing console 140 of the audio stream from this microphone positioning and amplification system.

Conversely, the control program 130 may automatically decrease the relative volume at the mixing console 140 of the audio stream from a microphone positioning and amplification system as the camera's focal position 100 moves away from it. This ensures a fluid and seamless final audio blend as volume priority shifts gradually, and captured audio from outside the camera's focal position 100 is minimized in the final mix.

In further detail, still referring to FIG. 5, there may be times when it is desired to have the microphone positioning and amplification systems (10-1 to 10-N) stop reacting to positional data from camera 90-1 and change instead to positional data from an alternate camera 90-N. For example, when a broadcast switches to video from a different camera it may be desired to adjust the audio to correspond with the new field of view.

In one example, the control program 130 receives positional data from all video cameras (90-1 to 90-N) and switches which camera's data it interprets and forwards to each of the microphone positioning and amplification systems (10-1 to 10-N).

In another example, each of the video cameras (90-1 to 90-N) outputs its positional data through the network 120 to each of the microphone positioning and amplification systems (10-1 to 10-N) without the control program 130 first interpreting the data. In this case, the control program 130 issues a command to each of the microphone positioning and amplification systems (10-1 to 10-N) informing them which camera's positional data should be used when calculating the required position/orientation for an affixed microphone (28-1 to 28-N).

In either example, the control program 130 updates which camera's target field of view is considered when calculating the distance between the center of this focal position 100 and each of the microphone positioning and amplification systems (10-1 to 10-N). The control program 130 issues commands to the mixing console 140 such that the relative volumes from each microphone positioning and amplification system (10-1 to 10-N) are adjusted accordingly.

This disclosure has described exemplary embodiments, but not all possible embodiments of the systems and methods. Where a particular feature is disclosed in the context of a particular example, that feature can also be used, to the extent possible, in combination with and/or in the context of other examples. The systems and methods may be embodied in many different forms and should not be construed as limited to only the examples described here.

The systems and methods are not limited to the details described in connection with the example embodiments. There are numerous variations and modification of the systems and methods that may be made without departing from the scope of what is claimed.

That which is claimed is:

1. A microphone positioning system comprising:

a microphone coupler configured to hold a microphone;

a microphone positioning mechanism having a low noise motor drive that moves the microphone coupler to different positions;

a microphone cable connector carried by the microphone positioning mechanism;

a microphone preamp carried by the microphone positioning mechanism and in signal communication with the microphone cable connector; and a cable connector carried by the microphone positioning mechanism and in signal communication with the low noise motor drive, the cable connector being configured to receive remote control signals that operate the low noise motor drive and move the microphone coupler.

2. The microphone positioning system of claim 1, wherein the low noise motor drive has a switching frequency of at least 20 kHz.

3. The microphone positioning system of claim 1, wherein the microphone positioning mechanism includes a housing containing the low noise motor drive, microphone cable connector, microphone preamp, and cable connector.

4. The microphone positioning system of claim 3, wherein the housing is waterproof.

5. The microphone positioning system of claim 1, further comprising a media networking module carried by the microphone positioning mechanism and in signal communication with the microphone preamp, the media networking module being configured to generate AoIP data.

6. The microphone positioning system of claim 1, further comprising a cable connected to the cable connector, the cable being configured to transmit the remote control signals to the microphone positioning mechanism and to transmit audio signals from the microphone positioning mechanism.

7. The microphone positioning system of claim 1, further comprising:

a microphone coupled to the microphone coupler, the microphone being oriented along a focal axis; and a camera carried by the microphone positioning mechanism in such a way that the camera moves with the microphone coupler so that a focal position of the camera remains oriented substantially parallel to the focal axis when the microphone moves.

8. The microphone positioning system of claim 1, wherein the microphone positioning system is in communication with a network including a plurality of the microphone positioning systems.

9. The microphone positioning system of claim 1, wherein a distance between the microphone coupler and microphone cable connector is not more than two feet.

10. The microphone positioning system of claim 1, further comprising a computer in remote communication with the cable connector and that transmits the remote control signals.

11. A method comprising remotely capturing audio of an event at a venue by:

receiving, at a computer system over a network, positional data from at least one video camera connected to the network and placed at a location about the venue, the positional data corresponding to a focal position of the video camera; and operating, over the network, a plurality of remotely controlled microphones placed at different locations about the venue from the video camera by remotely orienting a focal axis of at least one of the microphones in such a way that the focal axis points at the focal position of the video camera;

receiving an audio stream from the plurality of microphones to form a composite audio stream;

increasing a relative volume in the audio stream from the microphones having their focal axis pointed at the focal position of the video camera relative to microphones not having their focal axis pointed at the focal position of the video camera; and from the microphones having their focal axis pointed at the focal position of the video camera, increasing a relative volume in the audio stream from the microphones that are closer to the focal position.

12. The method of claim 11, further comprising automatically reorienting the microphones in such a way that their the focal axis remains pointed at the focal position of the video camera as the focal position of the video camera moves.

13. The method of claim 11, wherein the remotely controlled microphones comprise:

a microphone coupler holding the microphone;

a microphone positioning mechanism having a low noise motor drive that moves the microphone coupler to different positions;

a microphone cable connector carried by the microphone positioning mechanism;

a microphone preamp carried by the microphone positioning mechanism and in signal communication with the microphone cable connector; and a cable connector carried by the microphone positioning mechanism and in signal communication with the low noise motor drive, the cable connector being configured to receive remote control signals that operate the low noise motor drive and move the microphone coupler.

14. The method of claim 11, wherein the low noise motor drive has a switching frequency of at least 20 kHz.

15. An audio system comprising:

(a) a network;

(b) a plurality of individual microphones placed at different locations, the individual microphones being respectively coupled to a microphone positioning mechanism in communication with the network;

(c) a control computer in communication with the network that executes program instructions to:

operate, over the network, the plurality of microphone positioning mechanisms by remotely orienting a focal axis of at least one of the microphones in such a way that the focal axis points at a focal position of a video camera in communication with the network, the video camera being at a different location than the at least one microphone; and (d) a mixing console that:

receives an audio stream from the plurality of individual microphones to form a composite audio stream;

increases a relative volume of the audio stream from the microphones having their focal axis pointed at the focal position of the video camera relative to microphones not having their focal axis pointed at the focal position of the video camera; and from the microphones having their focal axis pointed at the focal position of the video camera, increases a relative volume in the audio stream from the microphones that are closer to the focal position.

16. The audio system of claim 15, wherein the computer further executes program instructions to automatically reorient the individual microphones in such a way that their focal axis remains pointed at the focal position of the video camera as the focal position of the video camera moves.

17. The audio system of claim 15, wherein the microphone positioning mechanisms individually comprise:

a microphone coupler holding the microphone;

a microphone positioning mechanism having a low noise motor drive that moves the microphone coupler to different positions;

a microphone cable connector carried by the microphone positioning mechanism;

a microphone preamp carried by the microphone positioning mechanism and in signal communication with the microphone cable connector; and a cable connector carried by the microphone positioning mechanism and in signal communication with the low noise motor drive, the cable connector being configured to receive remote control signals that operate the low noise motor drive and move the microphone coupler.

18. The audio system of claim 15, wherein individual microphones are respectively connected to a low noise motor drive that orients the individual microphones.

19. The audio system of claim 18, wherein the low noise motor drive has a switching frequency of at least 20 kHz.

20. The method of claim 11, wherein individual microphones are respectively connected to a low noise motor drive that orients the individual microphones.

21. A method comprising remotely capturing audio of an event at a venue by:

receiving, at a computer system over a network, positional data from at least one video camera connected to the network and placed at a location about the venue, the positional data corresponding to a focal position of the video camera; and operating, over the network, a plurality of remotely controlled microphones placed at different locations about the venue from the video camera by remotely orienting a focal axis of at least one of the microphones in such a way that the focal axis points at the focal position of the video camera;

wherein the remotely controlled microphones comprise:

(a) a microphone coupler holding the microphone;

(b) a microphone positioning mechanism having a low noise motor drive that moves the microphone coupler to different positions;

(c) a microphone cable connector carried by the microphone positioning mechanism;

(d) a microphone preamp carried by the microphone positioning mechanism and in signal communication with the microphone cable connector; and (e) a cable connector carried by the microphone positioning mechanism and in signal communication with the low noise motor drive, the cable connector being configured to receive remote control signals that operate the low noise motor drive and move the microphone coupler.

* * * * *